United States Patent [19]

Berryman

[11] 4,059,167

[45] Nov. 22, 1977

[54] HYDRAULIC FISHING JAR HAVING TANDEM PISTON ARRANGEMENT

[75] Inventor: William O. Berryman, Houston, Tex.

[73] Assignee: Baker International Corporation, Orange, Calif.

[21] Appl. No.: 765,766

[22] Filed: Feb. 4, 1977

[51] Int. Cl.[2] ..... E21B 1/10

[52] U.S. Cl. ..... 175/297

[58] Field of Search ..... 175/296, 297

[56] References Cited

U.S. PATENT DOCUMENTS

| | | | |
|---|---|---|---|
| 2,621,024 | 12/1952 | Koppl et al. | 175/297 |
| 3,285,353 | 11/1966 | Young | 175/297 |
| 3,851,717 | 12/1974 | Berryman | 175/297 |

*Primary Examiner*—James A. Leppink
*Attorney, Agent, or Firm*—William C. Norvell, Jr.

[57] ABSTRACT

The present invention relates to a hydraulic fishing jar adapted to be run into a well on a fishing string and connected to a fishing tool in the well bore. The jar comprises inner and outer telescopically interengaged bodies. A plurality of diametrically defined pressure areas, each of said pressure areas having upper and lower sealed ends, are contained within the jar. Tandem piston means are immediate one of said upper and lower sealed ends of each of the pressure areas. Seal means are carried by one of the inner and outer interengagable bodies and are engagable by the other of the inner and outer interengagable bodies and define one of the upper and lower sealed ends of the pressure areas. Seal means are provided between the piston means and one of the inner and outer telescopically interengaged bodies and define one of the upper and lower sealed ends of the pressure areas. The pressure areas are in fluid communication with one another and define a chamber for receipt of lubricant therewithin.

17 Claims, 9 Drawing Figures

1
2
3
4
4A
5
6
7
8
9
10
11
12
13
14
16
16A
17
18
18A
20
21
22
23
24
25
26
29
30
32
33
35
36
37
40
40A
40B
40C
40D
41
42
42A
42B
43
44
45
46
46A
47
48
49
50
51
52
53
54
55
56
57
57A
58
59
60
60A
60B
61
62
63
64
65
66
67
68
69
70
71
72
73
74
75
76
77
78
78A
79
80
81
81A
82
83
84
85
86
87
88
89
91
92
93
94
95
96
97
98
99
100
101
101A
102
103
104
105
106
107
108
A-1
A-2
A-3
A-4
D-1
D-2
D-3
D-4
FT
$P_t$ 6
1
4A
5
4
2
8
22
9
3
20
21
26
25
24
23
10
29
11
12
37
43
33
32
35
39
32
47
44
40
51
53
54
48
50
56
49
58
61
59
64
40C
69
83
60
70
40B
104
60B
67
40A
72
76
103
75
85
74
78
79
77
80
81
88
81A
40D
78A
42B
86
42A
42
106
91
98
97
101
99
18A
18
7
FT

HYDRAULIC FISHING JAR HAVING TANDEM PISTON ARRANGEMENT

In a preferred form, hammer means are carried on one of the inner and outer telescopically interengaged bodies, while anvil means are carried on the other of the inner and outer bodies. The inner and outer bodies are interengaged within at least one of the pressure areas and the lubricated therein. The hammer and anvil means are within at least one of the pressure areas and are also lubricated therein. The tandem piston arrangement described above provides a total effective piston area whereby pressure within the tool may be maintained at minimum levels and permits all working components to be within one lubrication system. Accordingly, the tool may be operated at minimum pressures and may tolerate the application of maximum pulling load whereby maximum jarring load capability is afforded for a given size tool to obtain a comparatively high load rating for the tool.

BACKGROUND OF THE INVENTION

1. Field of the Invention

The present invention relates to a tandem piston arrangement incorporated in hydraulic fishing jars to increase the effective piston area thereof whereby hydraulic pressure is maintained at a minimum level in the jar permitting application of maximum pulling load to the jar to, in turn, obtain maximum jarring load capability for a given size jar.

2. Description of the Prior Art

Various types of fishing jars are employed for moving some stuck tool or tubular member or other object from a well bore, the stuck object being referred to as a "fish". Fishing jars are run at the lower end of a string of drill pipe or tubing which ordinarily is referred to as the fishing, running or working string and the fishing tool is engaged with the lower end thereof. The fishing tool may be a spear, or overshot or similar device, adapted to engage the fish so that the fish may be jarred loose by the jar and thereafter retrieved from the well bore.

Jars are employed for the purpose of applying hammer blows to aid in releasing the stuck fish while the fishing string is under tension. Jars of the hydraulic type, in general, are quite well known and comprise telescoping members. Upon expansion, a pressure chamber containing a quantity of hydraulic fluid resists elongation of the jar. However, when an upward strain or tension is applied to the running string, the hydraulic fluid is compressed and bleeds through a restricted flow passage, thus permitting a gradual telescoping of the tool until a large by-pass is opened and the induced pressure on the hydraulic fluid is instantaneously released. Since the fishing string is no longer resisted by the compressed fluid, the jar telescopes rapidly until such telescoping is stopped by engagement of a hammer and anvil that form part of the fishing tool which applies a jar to the fish.

In hydraulic fishing jars, one or more hydraulic cylinders are provided for effecting the jarring mechanism. As the drill pipe is picked up at the top of the well, the parts of the tools telescope such that fluid in the cylinder is compressed. Pressure build-up in the hydraulic cylinder or cylinders is directly proportional to the amount of pull applied to the tool. In jars having a piston element within the cylinder element, the build-up is inversely proportional to the area of the piston because of the inherent functioning of a piston within a pressurized chamber.

During the complete operation of the jar, two types of loads can be identified. While the drill pipe is being stretched before the tool is released to cause the hammer to interface with the anvil, a "jarring load" is applied to the tool. The force exerted on the anvil during the hammer-anvil interface is defined as the "impact load". After tripping of the tool, the jar mechanism can tolerate a much higher jarring load because there is no longer a pressure build-up within the hydraulic cylinder in the tool. However, during the stretching of the drill pipe and prior to the tripping of the jarring mechanism, the tool is limited to the jarring or pulling load because of pressure build-up within the hydraulic cylinder. If a jarring load is applied to the tool in excess of the design limits of the tool, the control mandrel may collapse or the housing may burst.

Because of the restricted inner and outer diameters of the jar mechanism, there is, by necessity, a limitation in space and area for incorporation of the piston mechanism. To increase the piston head area to obtain a maximum diameter thereof, a seal having a comparatively small diameter could be put around the control mandrel for the jar at the upper end thereof such that the outer diameter thereof is as small as possible, and a larger seal may be applied to the piston head such that the largest possible area is obtained between the piston seal and the mandrel seal. To obtain such a maximum effective piston area in prior art jarring tools, hammer and spline mechanisms would have to be removed from within the piston chamber. However, when these components are put outside of the piston chamber, they are, of necessity, placed exteriorly of the hydraulic and lubrication systems. Therefore, milling cuttings and other debris within the well may become easily entrapped into spline areas and may also cause deterioration of the hammer, anvil and other surfaces. Therefore, it would be desirable to provide a means for obtaining the maximum effective piston area while, at the same time, including all of the operational components of the jarring mechanism, including the hammer and spline mechanisms, into the hydraulic and lubrication system.

Plural hydraulic systems could be designed into the tool, the first system being under pressure to provide hydraulic activation of the tool. The second system would not be under pressure, but would be a balanced lubrication system enclosing the splines and the hammer. Use of such plural hydraulic systems presents numerous problems. For example, one such design would require the filling of two separate chambers with fluid. Additionally, each of the chambers would have to be pressure compensated, such that pressure inside the tool is balanced with the hydrostatic pressure outside of the tool in the well at the depth of the operation of the tool so that the tool will not burst or collapse from temperature expansion and contraction, and the like.

The present invention overcomes these obstacles by providing one utilized hydraulic and lubrication chamber mechanism having a plurality of interrelated chamber members. A plurality of piston elements are provided within the chamber, in tandem series, and communicating with respect to one another, such that the area of each piston head provides a total effective piston head area whereby pressure within the tool may be maintained at minimum levels. Additionally, use of such an arrangement permits all working components to be in one lubrication system. Accordingly, the jarring mechanism can be operated at minimum pressures within the interior of the tool, and can tolerate the application of maximum pulling load within the design limits of the tool whereby maximum jarring load capability is afforded for a given size tool. Thus, a comparatively high load rating may be obtained for the tool.

SUMMARY OF THE INVENTION

The present invention provides a hydraulic fishing jar which is adapted to be run into a well on a fishing string and connected to a fishing tool therebelow. The tool comprises inner and outer telescopically interengaged bodies. In a preferred form, a first diametrically defined pressure area has upper and lower sealed ends. A first tandem piston means is provided immediate one of said upper and lower sealed ends of the first pressure area. First seal means are carried by one of the inner and outer interengagable bodies and are engagable by the other of the inner and outer interengagable bodies and define one of the upper and lower sealed ends of the first pressure area. Second seal means between the first tandem piston means and one of the inner and outer bodies define the other of the upper and lower sealed ends of the first pressure area. A second diametrically defined pressure area is provided and has upper and lower sealed ends. A second tandem piston means is immediate one of the upper and lower ends of the second pressure area. A third seal means are carried by one of the inner and outer bodies and are engagable by the other of the inner and outer bodies and define one of the upper and lower sealed ends of the second pressure area. Fourth seal means are between the second tandem piston means and one of the inner and outer bodies and define the other of the upper and lower sealed ends of the second pressure area. Hammer means are carried on one of the inner and outer telescopically interengaged bodies and anvil means are carried on the other of the inner and outer telescopically interengaged bodies. The first and second pressure areas are in fluid communication with respect to one another and define a lubrication chamber therewithin. The inner and outer bodies are interengaged within at least one of the first and second diametrically defined pressure areas of lubrication thereof. The hammer and the anvil means also are within at least one of the first and second diametrically defined pressure areas and are lubricated thereby.

DESCRIPTION OF THE PREFERRED EMBODIMENTS

Referring now to the Figs. , the hydraulic fishing jar of the present invention is referred to generally by the numeral 1. It comprises a telescoping inner body 2 within an outer elongated housing 3.

Figures 1A, 1B, 1C:
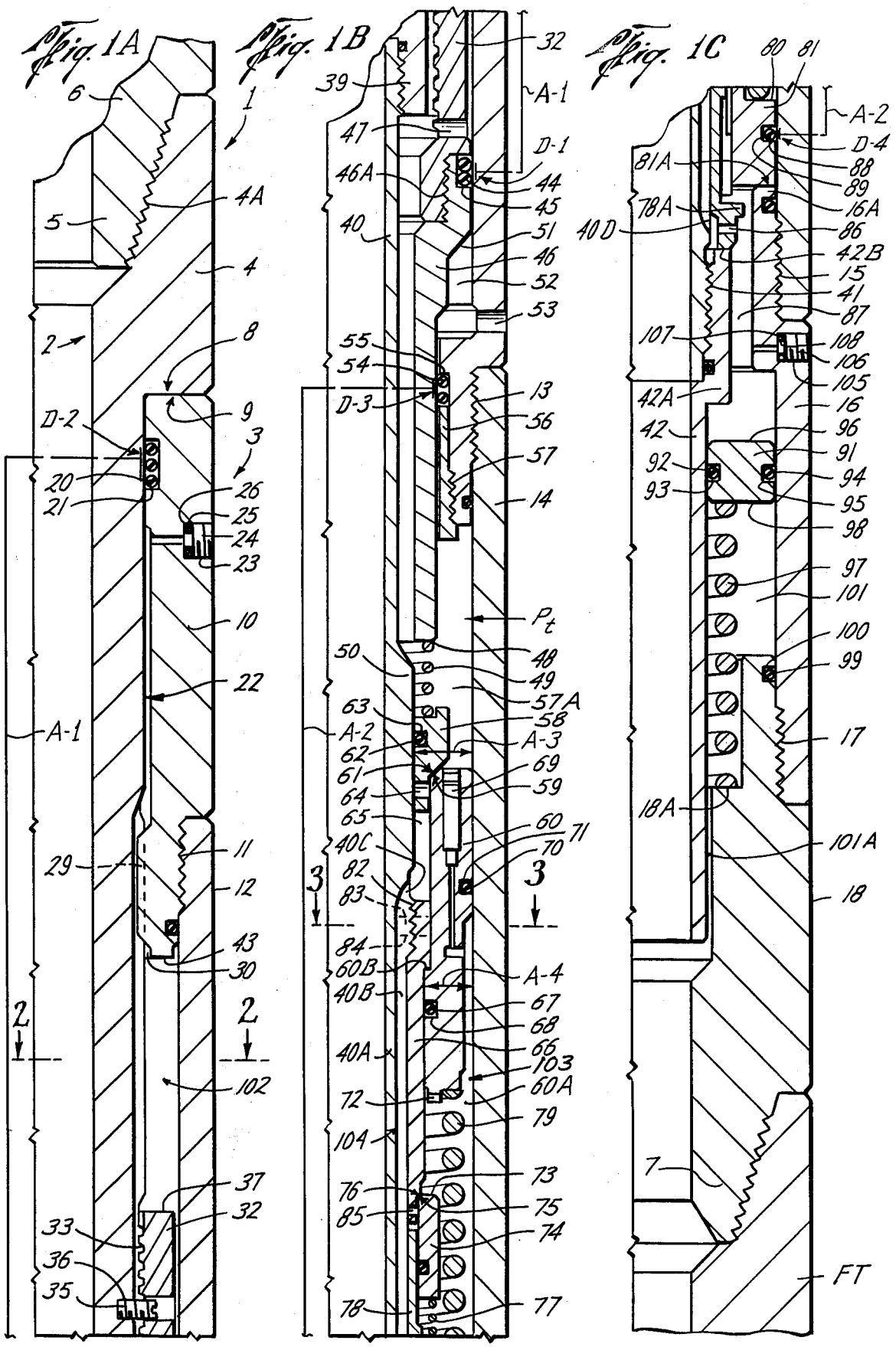
FIGS. 1A through 1C together constitute generally a longitudinal partial quarter section of a jarring tool of the preferred form of the present invention installed in a fishing string and illustrates the position of the components when the tool is in a collapsed relation.

The inner body 2 at its upper end is defined by an elongated tubular mandrel 4 provided with thread elements 4A and is adapted to receive the externally threaded pin 5 at the lower end of the upwardly extended section of fishing string or collar or other tubular member 6 constituting a portion of the running or fishing string on which the fishing jar 1 is run into the well bore, and by which the jarring tool is operated to provide a jarring action for a fishing tool which may be designated FT and which is connected to the threaded pin portion 7 defining the lowermost end of the outer housing 3, as more clearly seen in FIG. 1C.

Although not shown in the drawings, several joints of drill collars may be incorporated within the fishing string 6 above the fishing jar 1. Additionally, a bumper sub may be incorporated into the fishing string 6 either above or, more preferably, below the fishing jar 1.

The outer housing 3 is comprised of a splined housing member 10 circumferentially extending around the upper exterior of the inner body 2, and is connected by threads 11 to an elongated upper housing element 12, which, in turn, is affixed at its lower end by means of threads 13 to a longitudinally extending cylindrical companion lower housing 14. The lower housing 14 is affixed at its lowermost end by means of threads 15 to a compensating piston housing member 16 circumferentially extending therebelow and which, in turn, is affixed at its lowermost end by means of threads 17 to a bottom sub member 18 which terminates the outer housing 3.

The splined housing 10 has at its upper end an upper surface 9 for companion shouldering with a lower shoulder 8 on the mandrel 4. Additionally, the splined housing 10 carries a plurality of circumferentially extending O-rings 20 within the grooveway 21, the O-rings extending around the exterior of the mandrel 4. The O-rings 20 are slidable along the longitudinally extending experior surface of the spline mandrel 4, the surface being identified as 22. A filler port 23 also is provided on the splined housing 10 for receipt of a filler plug element 24 carrying thereon a longitudinally circular O-ring element 25 within a companion longitudinally and circularly defined grooveway 26, the filler port and plug providing a means for filling and thereafter plugging the hydraulic and lubrication chambers hereinafter defined. A companion filler port 105 is defined within the compensating piston housing 16 for receipt of a plug 106 having a seal ring 107 thereon within grooveway 108. The lower annular end of the splined housing 10 defines an anvil 43 upon which the hammer upper end 37 on the mandrel 4 strikes to deliver a jar.

the mandrel 4 is provided immediate its upper end with a plurality of elongated circumferentially spaced splineways 27 having elongated splines 28 extending longitudinally between the splineways 27 which elongated, circumferentially spaced splineways 27 are adapted to receive the circumferentially spaced companion splines 29 formed on the splined housing 10. The circumferentially spaced companion splines 29 are provided with elongated recesses or splineways 30 for receiving the splines 28 on the spline mandrel 4. This arrangement provides a splined configuration for enabling the inner body 2 and its functionally associated parts and the outer body 3 to telepscope longitudinally relative to one another while inhibiting relative rotation therebetween, the splined configuration enabling transmisstion of torque through the tool during milling operations and the like, such that the tool rotates as a unit.

It will be appreciated that the splineways 27 and 30 and splines 28 and 29 will be of any suitable or longitudinal extent to accommodate the desired telepscopic movement of the spline mandrel 4 and its functionally associated parts with respect to the outer body 3 for compression of the hydraulic fluid in the chamber members and for release thereof to enable an upward blow to be delivered to the fish.

A hammer element 32 is secured on the spline mandrel 4 immediate the lower end thereof and below the spline arrangement by means of threads 33. The hammer element 32 is further secured in place by the threaded pin 35 extending through the hammer element 32 and into a companion bore 36 in the spline mandrel 4. The upper end 37 of the hammer element 32 provides the means for delivering an upward impact when the spline mandrel 4 and its associated parts are released relative to the outer body 3.

In addition to the mandrel 4, the inner body 2 also comprises a plurality of longitudinally extending tubular members threadedly secured together. Forming a portion of the inner body 2 and affixed below the spline mandrel 4 by threads 39 is a cylindrical by-pass mandrel 40 to which at its lower end is affixed by threads 41 a compensating piston mandrel 42.

The O-rings 20 provide means which define the upper end of a hydraulic fluid area generally referred to in the drawings as extending between the upper housing 12 and the spline mandrel 4. The fluid area Al extends longitudinally from theseal rings 20 between the outer housing 3 and the inner body 2 to a plurality of circumferentially extending O-rings 44 housed within their companion grooveway 45 on the upper end of a longitudinal extending seal mandrel 46 affixed by threads 46A to the hammer element 32. The first or upper fluid area Al defined between the seal 20 and 44 is indicated by diameters D1 and D2, D2 being the outer diameter of the spline mandrel 4 at the O-rings 20, and the diameter D1 being the internal diameter of the upper housing 12 at the O-rings 44.

Within the hammer element 32 and immediately above the O-rings 44 is a passageway 47 extending through the hammer 32 for transmission of fluid immediate the hammer 32. Below the hammer 32 and carried thereby is the seal mandrel 46, the upper end of which acts as the first or upper tandem piston in association with the first or upper tandem piston area Al. The seal mandrel 46 carries at its upper end the rings 44 and has a lower end 48 abutting the uppermost end of a dump valve spring 49 circumferentially defined around a longitudinally extending outer protrusion 50 on the by-pass mandrel 40. The seal mandrel 46 has defined below a bevel 51 a low pressure chamber 52 exposed to hydrostatic pressure within the well by means of hydrostatic passageway 53 defined on and extending through the upper housing 12.

A plurality of O-ring elements 54 encircle the exterior of the seal mandrel 46 and are housed within their grooveway 55 defined in a longitudinally extending seal retainer 56 engaged to the upper housing 12 by means of threads 57.

The dump valve spring 49 is operatively associated with a dump valve member 58 and urges the member 58 into closed position with respect to a seal shoulder 59 upon the upper end of a regulating piston 60 adjacent thereto, the seal shoulder 59 and a companion seal shoulder 61 on the dump valve member 58 providing a metal-to-metal seal between the dump valve member 58 and the regulating piston 60 when the dump valve spring 49 urges the dump valve 58 into sealing engagement with the regulating piston 60, prior to activation of the tool. An O-ring 62 is provided within its grooveway 63 and circumferentially extends around the exterior of the by-pass mandrel 40, the O-ring 62 being carried by the dump valve member 58. Additionally, the dump valve member 58 provides portal member 64 extending therethrough to permit selective fluid communication between the chamber 57A thereabove and the slots 40B within slotted by-pass means 40A on the by-pass mandrel 40, the fluid within these slots initially being at hydrostatic pressure and isolated from the fluid within chamber member 57A.

The regulating piston 60 is operatively associatable with, but is not connected to, an upper by-pass sleeve 66, an O-ring 67 within its grooveway 68 being carried by the regulating piston 60 and preventing fluid communication between the regulating piston 60 and the upper by-pass sleeve 66.

A constant flow regulating means or valve 69 is defined in the regulating piston 60 and is of well known configuration and will transfer hydraulic fluid from the hydraulic compression chamber member 60A therebelow to the hydraulic compression chamber member 57A thereabove at substantially a constant flow rate. Since such a substantially constant flow regulating valve is of well known construction and may be obtained commercially, it is not deemed necessary to give a detailed description, as it is well known to those skilled in the art. Reference is made to applicant's U.S. Pat. No. 3,851,717 entitled "Substantially Constant Time Delay Fishing Jar" for a detailed discussion of the function and operation of this valving means.

A circumferentially extending O-ring 70 is carried within a grooveway 71 therefor and within the regulating piston 60 to prevent fluid communication between the regulating piston 60 and the lower housing 14 extending exteriorly therearound. The regulating piston 60 has its lower end 72 for contact with a companion upper end 73 of a pilot valve member 74, the pilot valve member 74 having a valve seat 75 immediate the upper end thereof for normal engagement with a companion seat member 76 on the upper by-pass sleeve 66, the seat members 75 and 76 when, in engagement, forming a metal-to-metal seal between the upper by-pass sleeve 66 and its pilot valve member 74. A pilot valve spring 77 extends below and engages the lower end of the pilot valve member 74 and urges the pilot valve member 74 against the pilot valve seat 75, the valve spring 77 circumferentially extending around the exterior of a longitudinally extending lower by-pass sleeve 78. A spring 79 extends circumferentially within the chamber member 60A immediately below the regulating piston 60 and adjacent to the pilot valve member 74 between the upper by-pass sleeve 66 and the lower housing 14 and urges the regulating piston 60 against a stop element 60B on the upper by-pass sleeve 66 to position the regulating piston 60, the spring 79 having its lower end resting upon a shoulder 80 extending around the uppermost end of a power piston element 81.

The upper by-pass sleeve 66 is connected by threads 82 to the by-pass mandrel 40. A set screw 83 housed within its bore 84 extending within the by-pass mandrel 40 further secures the upper by-pass sleeve 66 to the by-pass mandrel 40 to prevent relative rotation between the members 66 and 40.

A portal member 85 is defined within the upper by-pass sleeve 66 and immediate the pilot valve member 74, the pilot valve member 74 normally closing off the port 85 to prevent fluid communication therethrough. The port 85 permits transmission of hydraulic fluid through slotted by-pass means 40A defined within the by-pass mandrel 40 when the lower end 72 of the regulating piston 60 contacts the upper end 73 of the pilot valve member 74 to shift the pilot valve member 74 to open position and expose the port 85. Thus, the port 85 allows communication of fluid when the pilot valve membe 74 opens, fluid being transmitted therethrough from the chamber member 103 having hydraulic fluid under pressure to chamber member 104 and having hydraulic fluid at hydrostatic pressure.

The by-pass mandrel 40 has defined thereon a series of longitudinally extending circumferentially spaced slots 40B for transmisstion of fluid between the pressurized hydraulic chamber members and the chamber members at hydrostatic pressure. The slots 40B terminate at their upper ends 40C, and fluid is permitted to be entrapped above the ends 40C and within the hydrostatic fluid passageway 65 immediate the regulating piston 60 and below the dump valve 58, until such time as the dump valve 58 is disengaged from the regulating piston 60 and the metal-to-metal seal formed by the 59-61 interface becomes disengaged. The slotted members 40A in the by-pass mandrel 40 terminate at their lower ends 40D, but fluid is permitted to be transmitted through port 86 defined within the lower end of the lower by-pass sleeve 78, and for communication with the hydrostatic pressure chamber member 87.

The power piston 81 is housed between the lower housing 14 and the by-pass sleeve 78 and is the second or lower piston of the tandem piston arrangement and is operably associatable with the second or lower tandem piston area A2. An O-ring 88 within its grooveway 89 is housed on the power piston 81 and circumferentially extending around the exterior thereof to prevent fluid communication between the power piston 81 and the lower housing 14. Lower longidutinal travel of the power piston 81 is prevented by means of the upper shoulder 16A on the compensating piston housing member 16, which normally engages the lower end 81A of the power piston 81. The power piston 81 is permitted to travel within the hydraulic chamber member 60A thereabove upon activation of the fishing jar 1 when the lower end 81A is engaged by the protruding shoulder 78A on the lower by-pass sleeve 78, thus forming a metal-to-metal seal at the 81A-78A interface to isolate hydrostatic pressure from compression chamber member 60A. The spring 79 rests against the upper shoulder 80 and urges the power piston 81 against the compensating piston housing member 16 when the first jar 1 is in its collapsed postion.

The second hydraulic pressure chamber A2 is defined at its upper end by diameter D3 at the O-rings 54 carried around the exterior of the seal mandrel 46, the diameter D3 being the outer diameter of the seal mandrel 46. The lower end of the chamber A2 is defined by diameter D4 at the O-ring 88 circumferentially extending around the exterior of the power piston 81, the diameter D4 being the internal diameter of the lower housing 14 at the O-ring 88.

The by-pass mandrel 40 is affixed at its lower end by threads 41 to the longitudinally extending compensating piston mandrel 42 therebelow, the compensating piston mandrel 42 defining an upper portion 42A having, in turn, thereon an upper shoulder 42B normally contacting the lowermost end of the upper by-pass sleeve 66. Below the upper portion 42A and between the compensating piston housing member 16 and the compensating piston mandrel 42 is a compensating piston 91 extending circumferentially around the exterior of the mandrel 42. The compensating piston 91 carries thereon an O-ring 92 within a grooveway 93 for sliding and sealing engagement along the exterior surface of the compensating piston mandrel 42. The compensating piston 91 also carries a companion O-ring 94 housed within its grooveway 95 for sliding, sealing engagement along the interior wall of the compensating piston housing 16. The upper end 96 of the compensating piston 91 is exposed to the pressure chamber member 87 thereabove. A compressed spring 97 extending circumferentially around the exterior of the compensating piston mandrel 42 engages the lower end 98 of the compensating piston 91, urging the piston upwardly, the lower end of the spring 97 resting upon an upper shoulder 18A of the bottom sub 18. O-ring element 99 defined within a grooveway 100 on the bottom sub 18 prevents fluid communication between the bottom sub 18 and the compensating piston housing 16.

The fluid chamber 101 immediate the lower end of the compensating piston 91 between the mandrel 42, the piston housing member 16 and the bottom sub 18 is open to well pressure immediate the tool by means of open passageway 101A.

It can be seen from the above that there is provided two pistons in tandem arrangement, namely the upper end of the seal mandrel 46 and the power piston 81. The two tandem piston elements are functionally associatable with respective hydrostatic pressure chambers 52 and 87.

It can also be seen from the above description that two high pressure chambers are provided and are selectively communicable with one normally low pressure chamber. The first high pressure chamber 102 terminates at its upper end by the O-rings 20 and extends therebelow between the splined housing 10 and the mandrel 4, continuing downwardly below the anvil 43 and the hammer end 37, thence between the hammer 32 and the upper housing 12, through the passageway 47, thence through the chamber area defined between the by-pass mandrel 40 and the seal piston or mandrel 46, and terminating at its lower end within chamber member 57A. The second high pressure chamber 103 extends below the constant flow regulator valve 69 initially through the passageway 69A in the regulating piston 60, thence through the chamber area 60A defined between the regulating piston 60 and the lower housing 14, the second high pressure chamber 103 terminating at its lower end at the O-ring 88, on the power piston 81. The third or normally low hydraulic pressure chamber 104 is defined at its upper end by hydrostatic pressure chamber member 65 extends downwardly through the upper end 40C of the longitudinally extending slots in the by-pass means 40A, thence by means of the lower end 40D, the port 86, and terminates within pressure chamber member 87 above the compensating piston 91.

The pressure within the chamber 102 can be defined as $P_t$. $P_t$ is equal to the pulling load divided by the sum of area A1 plus the area A2. A1 may be obtained by the following formula: $A1 = \pi \times (D_1^2 - D_2^2/4$. The lower chamber area A2 may be obtained from the following formula: $A2 = \pi \times D_4^2 - D_3^2/4$. Thus, in order to keep pressure as low as possible within the tool, the effective piston area obtained by the tandem piston arrangement as above described must be as large as possible. It can be seen by utilization of the tandem piston arrangement that a large effective piston area (A1 plus A2) is obtainable while, at the same time, affording incorporation of the hammer, anvil and spline areas within the hydraulic chamber area to provide lubrication thereof and to prevent exposure of these tool parts to well bore fluid contamination.

The determination of $P_t$ in accordance with the formula set forth above may be illustrated by identifying the diameters $D_1$ through $D_4$ in a representative jarring mechanism having an outer diameter of four and three-fourths inches. For illustrative purposes, in a jarring mechanism having a four and three-fourths inch O.D., and with a construction as shown in the Figs., $D_1$ is approximately 4.00 inches, $D_2$ is approximately 3.12 inches, $D_3$ is approximately 3.12 inches, and $D_4$ is approximately 4.00 inches. Thus, A1 is equal to 4.92 inches. Because $D_2$ and $D_3$ are equal, and because $D_1$ and $D_4$ are equal, A1 and A2 also will be equal. Therefore, each of A1 and A2 are equal to 4.92 inches, and $P_t$, for a maximum recommended pulling load of 90,000 pounds, is equal to 9,140 p.s.i.

The O-ring 62 housed within the dump valve 58 and the O-ring 70 carried on the regulating piston 60 define one effective cross-sectional area adjacent one end of the regulating piston 16 responsive to compressed hydraulic fluid within the compression chamber 102 and which is illustrated at A3 in FIG. 1B. Similarly, seal means 70 on the regulating piston 60 between the piston 60 and the lower housing 14 and the seal means 67 carried at the lower end of the regulating piston 60 for sealing engagement between the piston 60 and the upper by-pass sleeve 66 define an effective cross-sectional area illustrated at A4 adjacent the other end of the regulating piston 60 and which is responsive to compressed hydraulic fluid in compression chamber 103. The fishing jar 1 is designed and constructed so that cross-sectional area A3 defined by its respective seals described above is larger than the cross-sectional area A4 defined by its respective seals defined above.

OPERATION

Prior to utilization of the fishing tool 1 of the present invention, the chambers 102, 103 and 104 are permitted to be filled with hydraulic fluid, which also serves as a lubricant for the moving parts to resist frictional wear, by means of the port 23 and companion port 105 on the outer housing 3. Thereafter, the plug elements 24 and 106 are engaged within their respective ports 23 and 105, the seal rings 25 and 107 providing sealing engagement between the plugs and the outer body 3.

Figure 2:
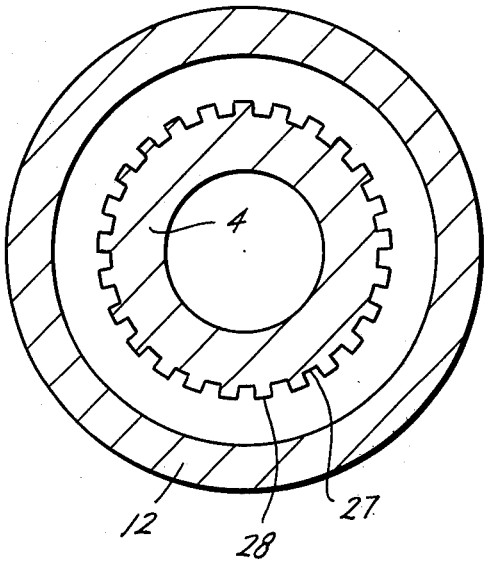
FIG. 2 is a cross-sectional drawing taken along lines 2—2 of FIG. 1A illustrating the construction of the splines and splineways.
Figure 3:
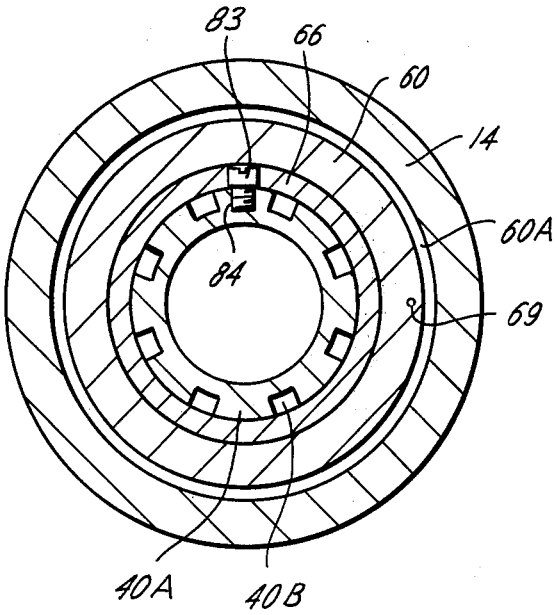
FIG. 3 is a cross-sectional view taken along lines 3—3 of FIG. 1B illustrating the by-pass grooves for transmission of fluid between the chamber members normally at hydrostatic pressure and the chamber members having pressurized fluid therein.
Figure 4:
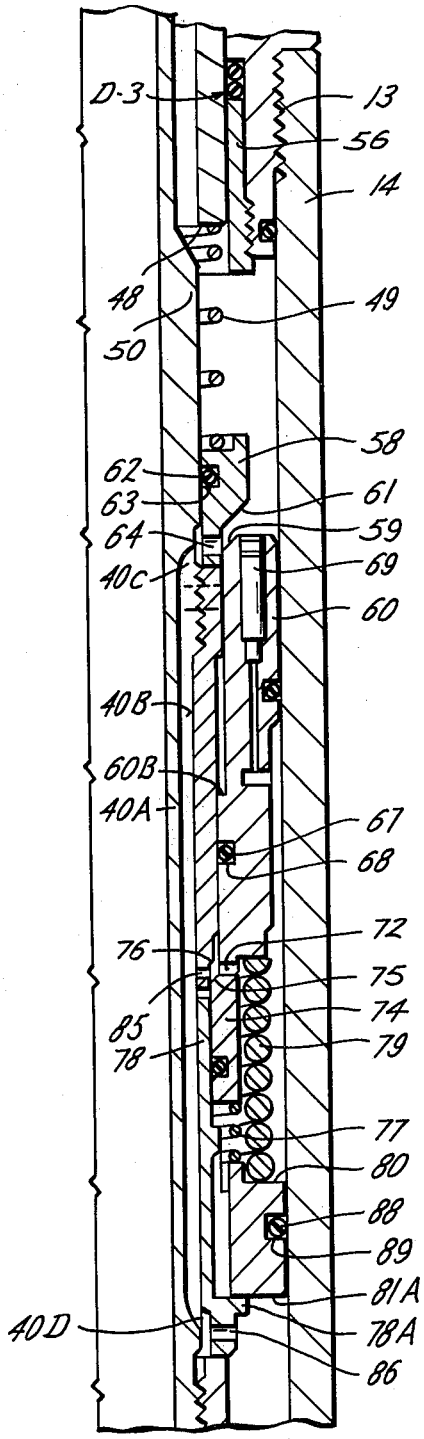
FIG. 4 is a longitudinal sectional view illustrating the respective ports in open position for transmission of fluid therethrough during activation of the jar and just prior to the hammer striking the anvil.
Figures 5A, 5B, 5C:
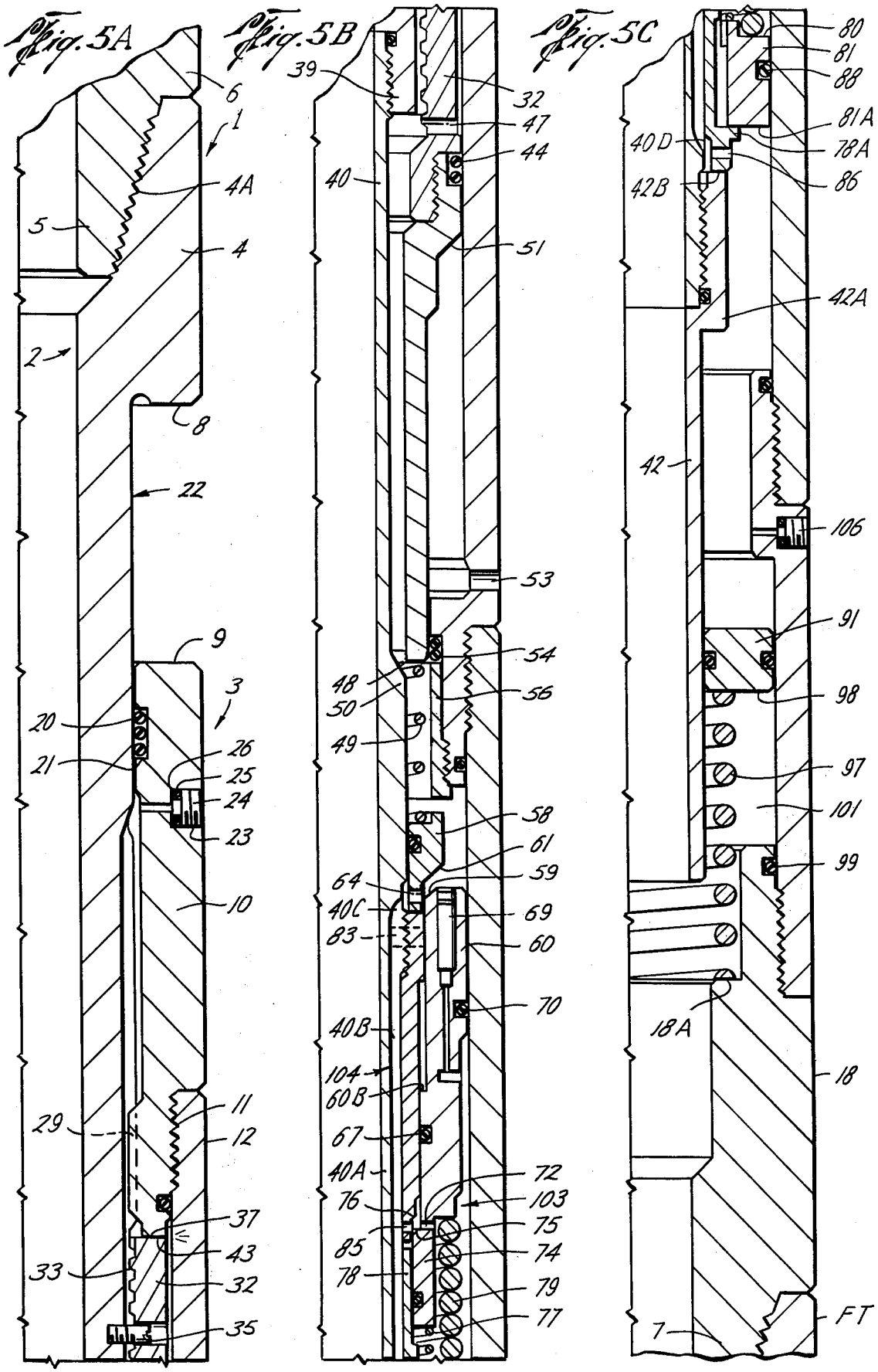
FIGS. 5A through 5C together constitute a fragmentary, generally longitudinal quarter section through portions of the jarring tool illustrated in FIGS. 1A through 1C, FIGS. 5A through 5C illustrating the components when the tool is extended and at the moment that an upward impact is delivered to the fish.

Referring now to FIGS. 2A through 2C, the components of the fishing jar 1 are shown in their relative position at the time that an upward jarring blow is delivered by the jar 1 to a fish engaged by the fishing tool FT.

In order to deliver an upward jarring blow to a fish in a well bore, the fishing tool FT is first engaged with the stuck fish when the operating string is lowered into the well bore. Thereafter, an upward strain is taken on the fishing or operating string at the earth's surface in a desired amount. Because of the design of the tool illustrated in the Figs., there is a relatively constant time delay from the time that the desired load is applied by the fishing string until the jar 1 is released to deliver an impact to the fish regardless of the jarring load applied, and the relatively constant time delay is independent of down hole temperature and pressures. As an upward strain or pull is applied at the earth's surface to the drill pipe or fishing string 6, it is transmitted through the mandrel 4 and its interconnected and associated parts as described above. The outer body 3 will remain stationary since it is connected to the fishing tool FT which, in turn, is secured to the fish to which the upward jarring impact are to be delivered.

Initially, when operator slacks off or releases the upward strain applied to the drill or fishing string 6 either to recock the jarring mechanism 1 or to bump down by means of utilization of a bumper sub (not shown), the mandrel 4 and the splined housing 10 will be shouldered at the 8–9 interface. Thereafter, the operator will pick up on the drill string 6 at the top of the well and, because of the operational function of the bumper sub, the operator will observe a free point because of free travel afforded by the bumper sub, this point being reflected by the weight indicator being stabilized. Accordingly, the mandrel 4 and its interrelated parts are permitted to travel upwardly relative to the outer body 3 which is longitudinally stabilized. The by-pass mandrel 40 affixed to the mandrel 4 moves upwardly with the mandrel 4 until the shoulder 78A on the lower by-pass sleeve 78 contacts and is sealingly engaged against the lower end 81A of the power piston 81, whereby the first and second high pressure chambers 102 and 103 are isolated from the low or hydrostatic pressure chamber 104.

As the drill pipe 6 is continued to be picked up and pulled, pressure is increased within the chambers 102 and 103. At this point, weight of the drill pipe 6 reflected on the weight indicator will increase because the drill pipe 6 is being stretched. The fishing string 6 continues to be picked up and downward force is exerted upon the dump valve member 58 and the regulating piston 60 which increases pressure within the chamber member 87 below the regulating piston 60. The pressure within the chamber member 87 will become slightly higher than the pressure $P_t$ exerted within the area defined as $P_t$ because cross-sectional area A3 defined by its respective seals is larger than the cross-sectional area A4 defined by its respective seals. Because the pressure in the chamber member below the regulating piston 60 is higher than the pressure exerted on the tool at $P_t$, fluid is caused to be transmitted through the regulating piston 60 by means of the constant flow regulating valve 69 defined thereon, flow being transmitted therethrough from below the regulating piston 60 to the chamber member 57A above the regulating piston 60. As the regulating piston 60 continues downward travel as the result of continued fluid flow as described above, the lower end 72 thereof engaged the upper end 73 of the pilot valve member 74, and downward force is exerted on the pilot valve member 74 until compressive force within the pilot valve spring 77 is overcome and the pilot valve member 74 is removed from its valve seat 75 and the port 85 extending through the upper by-pass sleeve 66 is opened. Accordingly, upon exposure of the port 85 in the upper by-pass sleeve 66, pressure within the chamber member 60A below the regulating piston 60 begins falling immediately because of fluid transmission through the port 85 by means of slotted passageways 40B within the by-pass mandrel 40, the pressure chamber 104 communicating therewith being at hydrostatic pressure and affording means for balancing or equalizing the pressure in the chamber member 60A below the regulating piston 60. Once the port 84 within the bypass mandrel 40 is opened, the downward longitudinal travel of the regulating piston 60 is increased substantially until the lower end 58A of the dump valve 58 carried immediate the regulating piston 60 engages the upper end 66A of the upper by-pass sleeve 66 and further downward longitudinal travel of the dump valve 58 is prevented. Accordingly, because the regulating piston 60 continues further longitudinal downward travel, the heretofore interfaced seal shoulders 59 and 61 are separated, whereby pressure and fluid within the upper chamber 102 is allowed to dump through the by-pass slots 40B, thereby removing resistance to upward travel of the mandrel 4 and its associated parts, which will thereafter be permitted upward longitudinal travel at a substantially increased rate.

As the fishing string 6 continues upward longitudinal travel, the mandrel 4 and its associated parts travel correspondingly upwardly. Fluid above the regulating piston 60 and in the chamber member 57A of the first or high pressure chamber 102 flows downwardly and through the hydrostatic fluid passageway 65, thence through the slotted members 40A in the by-pass mandrel 40, then communicating with the pressure chamber member 87. As a result of the upward travel of the mandrel 4, the hammer end 37 of the hammer element 32, which is affixed to the mandrel 4, travels upwardly within the lubrication and hydraulic chamber 102 above the upper piston defined at D1. Fluid is permitted to free flow from above the hammer end 37 through the passageway 47, thence within the pressure chamber 102. Additionally, fluid continues to be transmitted through the dump valve 58, thence through the slotted members 40A within the by-pass mandrel 40 and below the power piston 81 to the pressure chamber member 87. Accordingly, it can be seen that upward travel of the mandrel 4 and its interrelated parts causes fluid within the chambers 102 and 103 to be simultaneously transmitted within the initially hydrostatic chamber 104. Transmission of fluid as above described continues until the hammer end 37 contacts and strikes the anvil 43.

After the end 37 of the hammer 32 stikes the anvil 43 and an upward impact blow (the "impact load") is applied to the struck fish, the string 6 is permitted to slacken, whereby the mandrel 4 is permitted to move downwardly with resepct to the stable outer body 3. Because pressure now is built up beneath the power piston 81 and within the pressure chamber member 87, the power piston 81 becomes disengaged from the shoulder 78A allowing hydraulic fluid to flow from pressure chamber 104 to pressure chamber 103. Hydraulic fluid is permitted to flow from the low pressure chamber 104 into the first pressure chamber 102 by means of the slots 40B through the by-pass mandrel 40 and simultaneously through the hydrostatic pressure chamber member 65 and the port 64 in the dump valve 58 into chamber member 57A, such that the chamber member 102 continues to be filled with hydraulic fluid. The compressed force contained within the spring 79 urges the regulating piston 60 upwardly until such time as the regulating piston 60 engages the stop element 60B on the upper by-pass sleeve 66. At this point, the dump valve spring 49 urges the dump valve 58 against the regulating piston 60, such that a sealing interface is afforded at the 59–61 interface. The tool now is in position for initiation of the procedure as above described to afford second and subsequent upward jarring forces upon the stuck fish in the well.

The free floating piston 91 is pressure compensatable to equalize the pressure in the hydrostatic pressure chamber member 87 with the pressure in the fishing string since the underside of the piston 91 is exposed to the pressure present in the running or fishing string 6 therebelow.

The hydraulic jar of the present invention need only be assembled and filled with hydraulic fluid within the chambers as described above and connected to the fishing or drill string 6 for lowering into the well bore. After the fish is engaged by the fishing tool FT carried below the jar 1, any desired load may be applied to the jar, within its design limits, and within a substantially constant short period of time, after tension is initiated in the operating string as described herein, the jar will actuate and deliver an impact. The jar 1 may be repeatedly employed and the jarring load may be varied, that is, increased or decreased as desired, while the jar remains in the well bore. Additionally, the jar 1 may be repeatedly cocked in the well to apply successive jarring blows to the stuck fish.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is desired to be secured by Letters Patent is:

1. In a hydraulic fishing jar adapted to be run into a well on a fishing string and connected to a fishing tool in the well bore:

a. Inner and outer telescopically interengaged bodies;

b. First diametrically defined pressure area having upper and lower sealed ends;

c. First tandem piston means immediate one of said upper and lower sealed ends of said pressure area;

d. First seal means carried by one of said inner and outer interengagable bodies and engagable by the other of said inner and outer interengagable bodies and defining one of the upper and lower sealed ends of said first diametrically defined pressure area;

e. Second seal means between said first tandem piston means and one of said inner and outer interengagable bodies and defining the other of the upper and lower sealed ends of said first pressure area;

f. Second diametrically defined pressure area having upper and lower sealed ends;

g. Second tandem piston means immediate one of said upper and lower sealed ends of said second pressure area;

h. Third seal means carried by one of said inner and outer interengagable bodies and engagable by the other of said inner and outer interengagable bodies and defining one of the upper and lower sealed ends of said second pressure area; and i. Fourth seal means between said second tandem piston means and one of said inner and outer interengagable bodies and defining the other of the upper and lower sealed ends of said second pressure area;

said first and second fluid pressure areas being in fluid communication with one another, said first and second pressure areas defining a lubrication chamber therewithin.

2. The apparatus of claim 1 further comprising means for preventing relative rotational movement between said inner and outer telescopically interengaged bodies.

3. The apparatus of claim 1 further comprising means for preventing relative rotation between said inner and outer telescopically interengaged bodies, said means for preventing relative rotation being within at least one of the first and second pressure areas.

4. The apparatus of claim 1 further comprising hammer means carried on one of said inner and outer telescopically interengaged bodies and anvil means carried on the other of said inner and outer telescopically interengaged bodies.

5. The apparatus of claim 1 further comprising hammer means carried on one of said inner and outer telescopically interengaged bodies and anvil means carried on the other of said inner and outer telescopically interengaged bodies, said hammer means and said anvil means being within at least one of said first and second pressure areas.

6. In a hydraulic fishing jar adapted to be run into a well on a fishing string and connected to a fishing tool in the well bore:

a. Inner and outer telescopically interengaged bodies;

b. A plurality of diametrically defined pressure areas, each of said areas having upper and lower sealed ends;

c. Tandem piston means immediate one of said upper and lower sealed ends of each of said pressure areas;

d. Seal means carried by one of said inner and outer interengagable bodies and engagable by the other of said inner and outer interengagable bodies and defining one of the upper and lower sealed ends of said pressure areas; and e. Seal means between said piston means and one of said inner and outer telescopically interengaged bodies and defining one of the upper and lower sealed ends of said pressure ends.

said fluid pressure areas being in fluid communication with one another and defining a chamber for receipt of lubricant therewithin.

7. The apparatus of claim 6 further comprising means for preventing relative rotation between said inner and outer telescopically interengaged bodies.

8. The apparatus of claim 7 wherein said means preventing relative rotation between said inner and outer telescopically interengaged bodies is within at least one of said fluid pressure areas.

9. The apparatus of claim 6 further comprising hammer means carried on one of said inner and outer telescopically interengaged bodies and anvil means carried on the other of said inner and outer telescopically interengaged bodies.

10. The apparatus of claim 9 wherein said hammer and anvil means are within at least one of said fluid pressure areas.

11. In a hydraulic fishing jar adapted to be run into a well on a fishing string and connected to a fishing tool in the well bore:

a. Inner and outer telescopically interengaged bodies;

b. First diametrically defined pressure area having upper and lower sealed ends;

c. First tandem piston means immediate one of said upper and lower sealed ends of said first pressure area;

d. First seal means carried by one of said inner and outer interengagable bodies and engagable by the other of said inner and outer interengagable bodies and defining one of the upper and lower sealed ends of said first diametrically defined pressure area;

e. Second seal means mounted on said first tandem piston means and defining the other of the upper and lower sealed ends of said first pressure area;

f. Second diametrically defined pressure area having upper and lower sealed ends;

g. Second tandem piston means mounted on one of said upper and lower sealed ends of said second pressure area;

h. Third seal means carried by one of said inner and outer interengagable bodies and engagable by the other of said inner and outer interengagable bodies and defining one of the upper and lower sealed ends of said second pressure area; and i. Fourth seal means mounted on said second tandem piston means and defining the other of the upper and lower sealed ends of said second pressure area;

said first and second pressure areas being in fluid commuication with one another, said first and second pressure areas defining a lubrication chamber therewithin.

12. The apparatus of claim 11 further comprising means for preventing relative rotation between said inner and outer telescopically interengaged bodies.

13. The apparatus of claim 12 wherein said means for preventing relative rotation comprises splines carried on at least one of said bodies and carried within splineways in at least one of the other of said bodies.

14. The apparatus of claim 12 wherein said means for preventing relative rotation are within at least one of said first and second pressure areas.

15. The apparatus of claim 11 further comprising hammer means carried on one of said inner and outer telescopically interengaged bodies and anvil means carried on the other of said inner and outer interengagable bodies.

16. The apparatus of claim 15 wherein said hammer and anvil means are carried within at least one of said first and second pressure areas.

17. In a hydraulic fishing jar adapted to be run into a well on a fishing string and connected to a fishing tool in the well bore;

a. Inner and outer telescopically interengaged bodies;

b. First diametrically defined pressure area having upper and lower sealed ends;

c. First tandem piston means immediate one of said upper and lower sealed ends of said first pressure area;

d. First seal means carried by one of said inner and outer interengagable bodies and engagable by the other of said inner and outer interengagable bodies and defining one of the upper and lower sealed ends of said first diametrically defined pressure area;

e. Second seal means mounted on said first tandem piston means and defining the other of the upper and lower sealed ends of said first pressure area;

f. Second diametrically defined pressure area having upper and lower sealed ends;

g. Second tandem piston means immediate one of said upper and lower sealed ends of said second pressure area;

h. Third seal means carried by one of said inner and outer interengagable bodies and engagable by the other of said inner and outer interengagable bodies and defining one of the upper and lower sealed ends of said second pressure area;

i. Fourth seal means mounted on said second tandem piston means and defining the other of the upper and lower sealed ends of said second pressure area;

j. Hammer means carried on one of said inner and outer telescopically interengaged bodies and anvil means carried on the other of said inner and outer interengagable bodies; and k. Means for preventing relative rotation between said inner and outer telescopically interengaged bodies;

said first and second pressure areas being in fluid communication with one another, said first and second pressure areas defining a lubrication chamber therewithin, said inner and outer bodies being interengaged within at least one of the first and second diametrically defined pressure areas, said hammer means and said anvil means being within at least one of said first and second diametrically defined pressure areas, and said means for preventing relative rotation between said inner and outer telescopically interengaged bodies being within at least one of said first and second diametrically defined fluid pressure areas.

* * * * *